United States Patent [19]

Bradshaw et al.

[11] Patent Number: 4,900,392

[45] Date of Patent: Feb. 13, 1990

[54] SLIDABLE INDICIA ALIGNMENT AND TRANSFER DEVICE

[75] Inventors: Franklin C. Bradshaw; Jeffery C. Saxton, both of Scottsdale, Ariz.

[73] Assignee: Product Search, Inc., Scottsdale, Ariz.

[21] Appl. No.: 251,314

[22] Filed: Sep. 30, 1988

[51] Int. Cl.[4] ..... B65C 1/00; B65C 9/20

[52] U.S. Cl. ..... 156/541; 156/235; 156/240; 156/384; 156/540; 40/595; 33/623

[58] Field of Search ..... 156/235, 540, 541, 542, 156/230, 240, 384; 40/595; 33/445, 467, 623; 269/47, 49; 434/90

[56] References Cited

U.S. PATENT DOCUMENTS

| | | | |
|---|---|---|---|
| 3,761,344 | 9/1973 | Mrozck et al. | 40/595 X |
| 3,897,587 | 7/1975 | Molner | 156/240 X |
| 4,183,143 | 1/1980 | Root | 156/230 X |
| 4,202,637 | 5/1980 | Tummolo | 156/230 X |
| 4,230,513 | 10/1980 | Cugini, Sr. et al. | 156/562 X |
| 4,339,886 | 7/1982 | Griffiths et al. | 40/595 |
| 4,342,155 | 8/1982 | Waldron | 156/235 X |
| 4,440,590 | 4/1984 | Collins et al. | 156/235 X |
| 4,564,414 | 1/1986 | Houssian et al. | 156/541 |

*Primary Examiner*—Robert A. Dawson
*Assistant Examiner*—Michele K. Yoder
*Attorney, Agent, or Firm*—Gregory J. Nelson

[57] ABSTRACT

An alignment and transfer device for transferring selected indicia from a backing sheet to a substrate which includes a slide movable along a track. A protector sheet with a release agent is secured to the track. A grid transfer sheet is attached to the slide and has a low-tack adhesive on its underside. Indicia are temporarily transferred to the underside of the grid sheet by applying manual pressure through the grid transfer sheet as by a burnishing operation. As composition proceeds, the slide is progressively moved to place transferred indicia in registry with the protector sheet to prevent damage or inadvertent adherence of the indicia. Once the composition is completed, the slide and grid sheet are desengaged from the track and moved so that the indicia may be permanently transferred to the substrate at the substrate location.

9 Claims, 3 Drawing Sheets

10
12
14
16
18
20
22
24
25
30
32
34
35
36
50
51
52
53
54
60
62
64
65
70
71
72
73
74
78
200
212
214
215
216
217
218
220
222
225
226
228
230
235
240
242
244
2
3
5

SLIDABLE INDICIA ALIGNMENT AND TRANSFER DEVICE

The present invention relates to a device for arranging indicia on a temporary substrate and transferring and applying the indicia to a permanent location. More particularly, the invention relates to an alignment grid and transfer device for temporarily mounting indicia such as numerals and letters of the type having a pressure-sensitive backing and which are provided on a backing sheet and for subsequently transferring the indicia to a permanent mounting location.

Die cut indicia in the form of letters and numerals having an adhesive surface and provided on a releasable backing are widely used by layout artists and graphic designers. These indicia are removed from their backing and arranged on a surface to provide professional quality legends and signs. The die cut indicia are provided in different type styles usually in fonts having multiple reproductions of the various letters and numerals. The user manually removes the selected numeral or letter from the backing using a finger or a sharp instrument such as a knife or razor. The selected letter or numeral is then transferred to the desired surface for permanent application.

Because of the tedious nature of manually transferring individual letters and numerals, various lettering alignment and transfer systems or arrangements for use with adhesive-backed indicia can be found in the prior art. For example, U.S. Pat. No. 3,761,344 discloses a reusable alignment device and method for aligning a group of individual adhesive labels and applying them to an object in their aligned condition. The alignment device includes a transparent transfer strip that is releasably carried on a backing card. The selected labels are positioned in aligned relationship on the transfer strip and the strip is then removed from the backing card to serve as a means for transferring the aligned labels to the object to be labeled. Grid-like guide lines may be provided either on the backing card or on the transfer strip.

While systems of this type are useful, they possess certain disadvantages. The transfer of the letters from the storage sheet to the transfer strip can be a tedious operation. Further, when the transfer strip with the appended letters is removed from the backing card, the upper portion of the letters is not supported and due to their flexible nature may stick to one another or may inadvertently become adhesively engaged to other objects. Further, the transfer sheet must be manually aligned with the object or surface on which the letters are to be placed without the aid of a convenient way of holding the transfer sheet.

Another lettering and alignment grid system is shown in U.S. Pat. No. 4,339,886. This patent discloses a lettering kit and releasable alignment grid for use with pressure-sensitive adhesive-backed letters and numerals. In use of the invention, the letters and numerals are separated from a backing sheet and placed adhesive-side-down on a grid sheet. As each letter is put into position on the grid, the user applies a light burnishing action to obtain adherence of the letters and numerals to the grid. The user then takes a transfer sheet and separates it from its backing and the transfer sheet is placed with its adhesive coating facing the letters and the grid release coating. The user then burnishes or rubs the transfer sheet to achieve adherence to the transfer sheet. The transfer sheet is removed and pressed lightly against the substrate and burnished to transfer the letters to the substrate.

Kits of the type shown in the '886 patent are also effective but are apparently for single or limited use. Further, kits of this general type require multiple transfer operations, first to a grid sheet and thereafter to a transfer sheet and thereafter to a transfer sheet and finally to the object on which the letters are to be placed. The multiple operations are time consuming and each additional transfer of the letters may expose the letters to possible damage. Also, the flexible transfer sheet is difficult to grasp and may tend to fold on itself during the transfer operation causing the sheet and letters to stick together.

Accordingly, there exists a need for simple and effective indicia transfer and alignment device in which the manual handling of the indicia is minimized and which further provides a slide mechanism for moving the grid sheet for better spacing and placement of the indicia and for supporting the grid sheet during the transfer operation.

Accordingly, it is a principal object of the present invention to provide an indicia transfer device having a slidable grid transfer sheet that permits the user to readily and conveniently achieve the proper spacing and placement of indicia for transfer to a surface.

Another object of the present invention is to provide a grid transfer sheet of the type on which the indicia are temporarily transferred from a backing sheet to the grid sheet on a movable slide which indicia are protected while temporarily residing on the grid transfer sheet.

Another object of the invention is to provide indicia transfer device with a grid transfer sheet which provides a convenient lay-out of the indicia providing grid reference guide lines for this purpose.

Other objects of the present invention are to provide a movable indicia transfer device of the type specially adapted for using pre-formed die cut pressure-sensitive adhesive-backed indicia of various sizes and shapes.

Another object of the present invention is to provide an indicia alignment and transfer device which has a flexible grid transfer sheet for temporarily receiving indicia during the lay-out procedure which device may be reused an indefinite number of times.

Another object of the present invention is to provide an indicia alignment and transfer device having a flexible grid transfer sheet which is attached to a slide member to assist in transporting and applying the indicia to a mounting location.

In accordance with the present invention, a track member, which in the preferred embodiment is in the general shape of a U-shaped channel, receives a transversely movable slide. The slide may be moved to a position disengaged from the track. A grid transfer sheet of clear plastic film with a low-tack adhesive on the underside is secured to the slide and moves with the slide. A lightly tinted protector sheet is attached to the track and the slide is engaged on the track at least partially underlies the grid transfer sheet. In use, die cut indicia are releasably provided on the surface of a sheet usually in a font of numerals and/or letters. The particular number or letter selected from the font is placed beneath the grid transfer sheet and the outer or upper surface of the grid transfer sheet is rubbed or burnished transferring the number or letter to the tacky under side of the grid transfer sheet. The process is repeated until a particular combination of alphanumeric characters have been transferred to the underside of the grid. As each selected indicia is transferred from its backing sheet to the grid, the slide is moved leftwardly so the transferred letters are protected from the work surface by the release-coated protector sheet. After the arrangement of letters and numbers have been composed, the grid transfer sheet and slide are removed from the track to transfer the letters to the mounting surface or substrate.

Other objects, uses and advantages will become obvious or apparent from consideration of the following detailed description and drawings in which like reference numerals indicate like parts throughout the several views. In the drawings.

Figures 1, 2, 3, 4, 5:
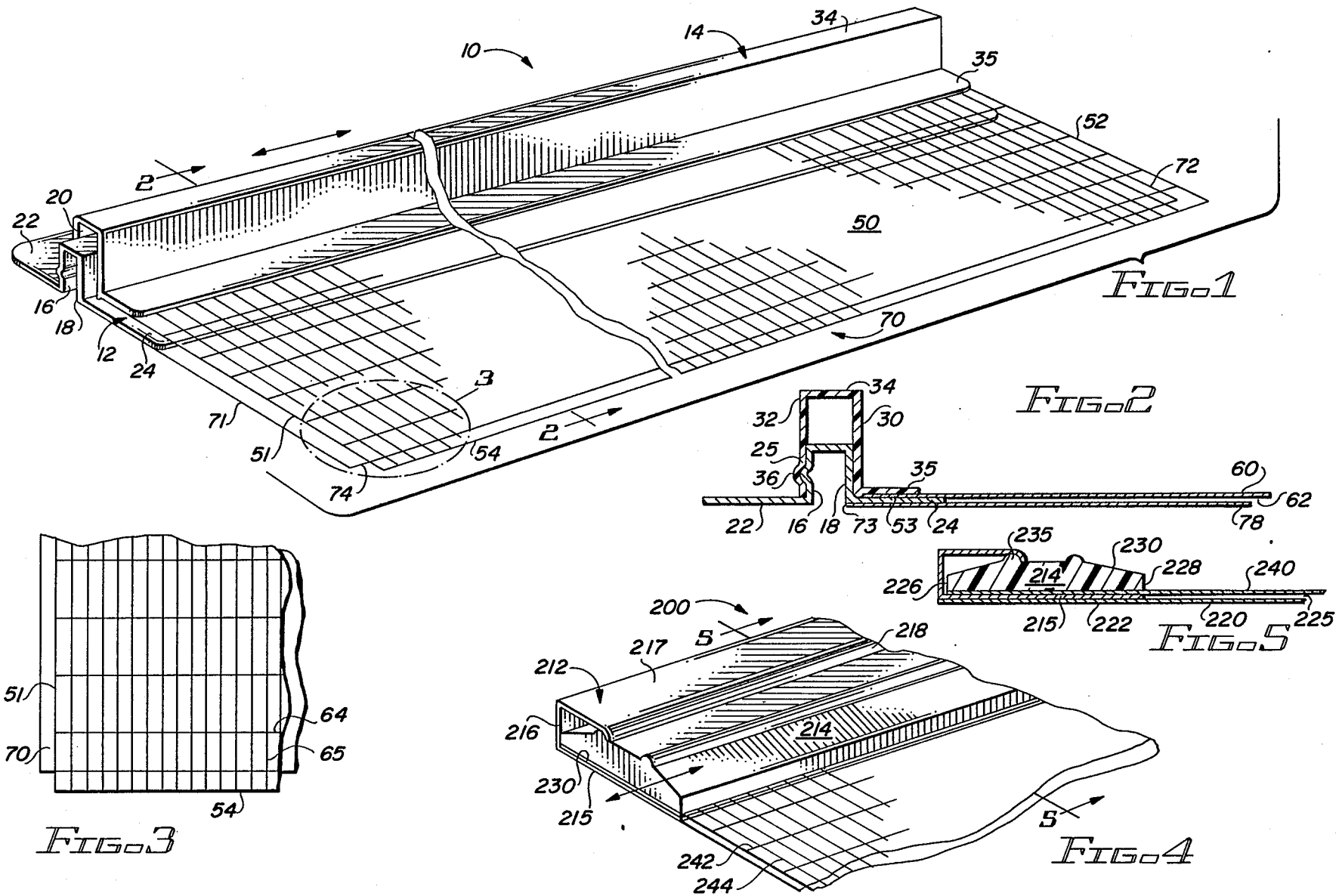
FIG. 1 is a perspective view of the movable indicia transfer and alignment device with the slide displaced rightwardly.
FIG. 2 is a sectional view taken along lines 2—2 of FIG. 1.
FIG. 3 is an enlarged detail view of a section of the grid transfer sheet and lower protector sheet as indicated in FIG. 1.
FIG. 4 is a perspective view partly broken away showing an alternate construction of the slide and track arrangement.
FIG. 5 is a sectional view taken along lines 5—5 of FIG. 4.
Figure 6:
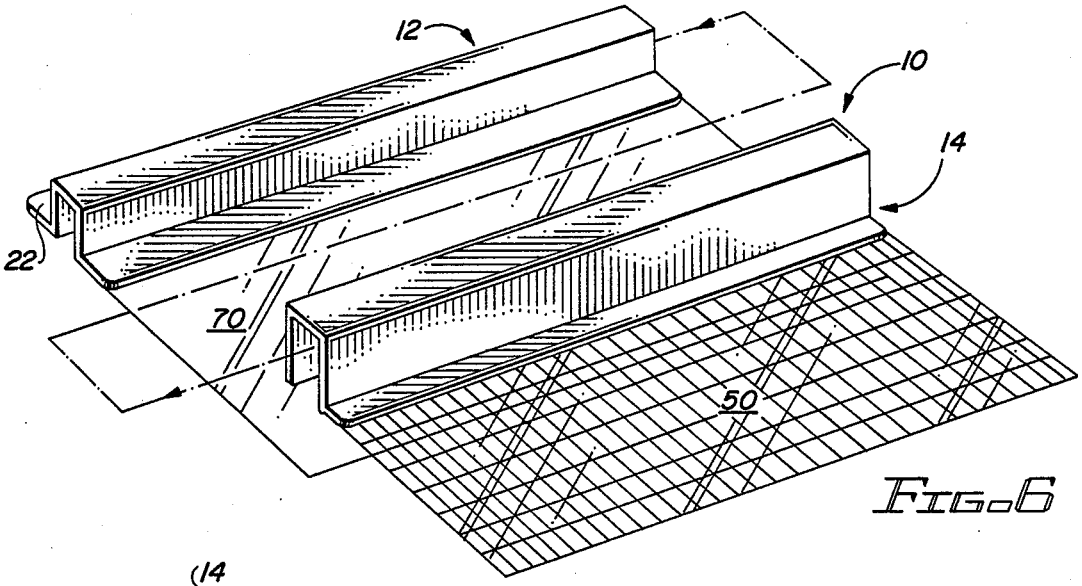
FIG. 6 is an exploded perspective view of the device of the present invention.
Figure 7:
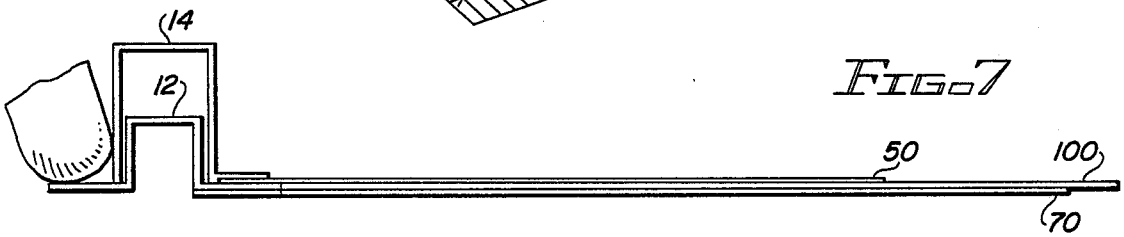
FIG. 7 is an end view of the device of FIG. 6 shown in position of use.

Referring to FIGS. 1 through 3, the indicia transfer and alignment device is generally designated by the numeral 10 and includes a track member 12 and a slide member 14 movable along the track. The track member 12 is preferably formed from aluminum or plastic and has inversely U-shaped body having side walls 16 and 18 with horizontally extending bight section 20 extending between the side walls. A flange 22 extends rearwardly from the lower end of rear side wall 16. A flange 24 extends forwardly from the lower end of front side wall 18. The terms "front" and "rear" are used with respect to the normal orientation of use with "front" designating an element oriented toward the user and "rear" designating a direction away from the user. Side wall 16 is provided with a longitudinally extending bead 25 to retain slide member 14 on the track. The track may be fabricated by any suitable method such as by extruding or molding and may be provided in any convenient length. For example, an overall length of approximately 18 inches is suitable for most applications.

Slide member 14 is movable along the track member 12 in either direction. Slide member 14 has parallel spaced-apart front and rear walls 30 and 32 respectively. The walls 30 and 32 are joined at their upper edge by horizontal bight member 34. As best seen in FIG. 2, the spacing of the front and rear walls is selected so that slide member 14 can easily slide and be guided by walls 16 and 18 of the track member. Rear wall 32 of the slide defines a longitudinally-extending recess 36 adapted to align with bead 25. Forwardly extending flange 35 extends from the lower end of wall 30 and is supported by forwardly extending flange 24 of the track.

Slide member 14 can be disengaged from the track 16 by lifting the slide member vertically. Walls 30 and 32 have sufficient flexibility to allow clearance over the bead 25. To place the members in engagement, they are positioned with the slide member above the trace member and forced together with the bead 25 "seating" in recess 32.

A grid transfer sheet 50 is carried in slide member 14 and serves as a guide. The grid transfer sheet is generally rectangular having opposite sides 51, 52, rear edge 53 and front edge 54. A marginal area 53 inward of rear edge 53 is secured to the underside of flange 35 and is interposed between flange 35 and flange 24. Accordingly, grid transfer sheet 50 is slidable with slide member 14.

The grid transfer sheet comprises a sheet of transparent polymeric film such as polyvinylchloride, polyethylene, polyester or similar material having an upper surface 60 and lower surface 62. As best seen in FIG. 3, a printed grid system comprising a plurality of longitudinally-extending parallel lines 64 intersected at regular intervals by perpendicular guide lines 65 which are also parallel and regularly spaced are incorporated in sheet 50. The grid system thus provides a guide or reference to a user for the proper spacing, placement and orientation of indicia on the grid transfer sheet.

The lower surface 62 of grid transfer sheet 50 forms a transfer surface for the temporary reception of indicia. As pointed out above, in the preferred form sheet 50 is a transparent film such as polyester or polyethylene film generally longitudinally co-extensive with the slide 14. Transfer surface 62 is provided with a low-tack adhesive coating, as well known to those in the art, such as a silicon or silicon rubber or any pressure-sensitive adhesive, i.e. acrylic, urethane, or polyvinylacetate. The preferred adhesive is 76 Res 9622, a vinyl acrylic adhesive manufactered by Union Chemicals, coated on 2 mil polyester film to a thickness of approximately 0.2 to 0.4 mils.

Protector sheet 70 underlies the grid having opposite sides 71 and 72, top edge 73 and lower edge 74. Protector sheet 70 has its marginal area adjacent edge 73 secured to the underside of flange 24 of member 12. Protector sheet 70 generally conforms in dimensions to the grid transfer sheet although the grid transfer sheet may extend forward beyond the front edge of the lower protector sheet. The protector sheet 70 is a sheet of polymeric film such as polyester, polyvinyl, polyethylene or other similar material. The upper surface 78 of sheet 70 is coated with a nonsticking, nonwetting release agent of the type well known to those in the art. The upper grid transfer sheet is transparent and the protector sheet is translucent or tinted to provide a distinguishable visual background.

In some instances, the adhesive on the indicia may wet the release coating on the upper surface of the protector sheet. For example this may occur if a silicon release coating such as polydemethylsiloxane is used. In this situation, the adhesion of the indicia to the release coating may be greater than the adhesion of the indicia to the grid transfer sheet preventing or impeding lateral movement of the grid transfer sheet and causing damage to the indicia already positioned on the grid transfer sheet.

To prevent the undesirable excessive adhesion of indicia to the release coating, the upper surface of sheet 70 is interrupted with 15 micron silica particles. The smooth surface becomes rough, similar to sandpaper so that the adhesive is unable to wet the entire surface because the contact area has been significantly reduced.

The non-wetting surface is created by dispensing 15 micron silica particles in a polymer matrix of polyvinyl acrylic such as Hyder 2671, manufactured by B. F. Goodrich, along with an acrylic resin such as that manufactured by Rohm & Haas and designated Rhoplex AC-235. The mix is applied to the 2 mil polyester film by conventional means. After completion, the polydimethylsiloxane is coated over the rough surface.

In use, the device is assembled as shown in FIGS. 1 and 2 with the slide 14 engaging the track 12 in a longitudinally slidable relationship. If a user wishes to compose a group of letters into a word or phrase, such as the word "ART" shown in FIGS. 8A–8G, the user begins first with a composite sheet of indicia 100. The composite sheet of indicia commonly used by graphic layout artists includes a font of letters and numbers and other indicia 103 which are die cut and adhesively secured to sheet 100. The backing sheet 100 preferably is a silicone coated film or paper coated with a suitable release agent so the letters may be easily removed or peeled from the backing surface as is well known in the art.

Figure 8A:
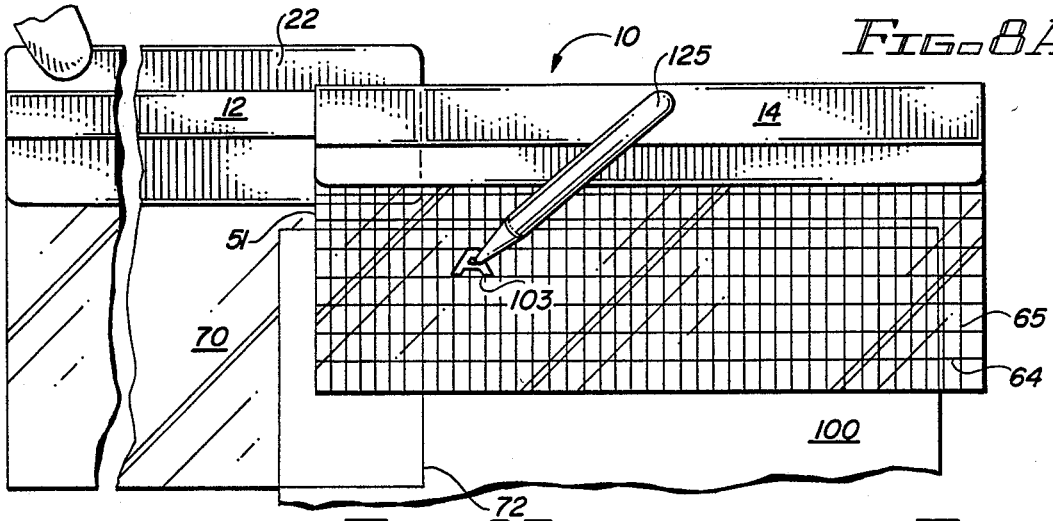
FIGS. 8A through 8G illustrate the sequential steps in the use of the indicia alignment and transfer device of the present invention.
Figure 8B:
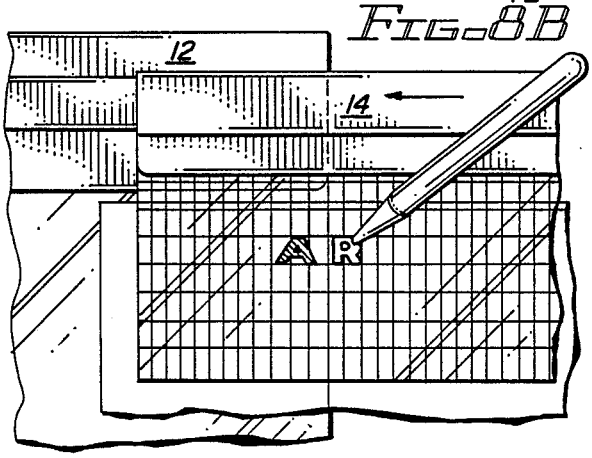
Figure 8C:
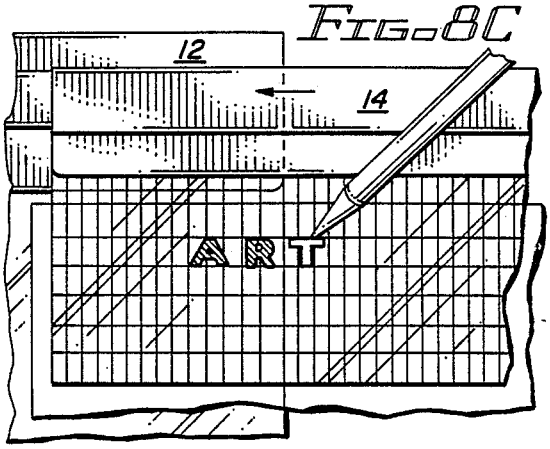

As seen in FIGS. 8A and 8C, the backing sheet 100 containing the selected indicia 104 is placed on a working surface and the device 10 placed adjacent the backing sheet. Slide 14 carrying the grid transfer sheet 50 is disposed in a rightward position with only a marginal portion of the sheet along edge 51 of the grid transfer sheet overlying the protector sheet 70. Backing sheet 100 is placed between the grid transfer sheet and the protector sheet and the grid sheet adjusted relative to the backing sheet so the selected number or letter, such as the letter "A", is positioned at the desired location at the underside of the grid transfer sheet 50. The grid lines 64 and 65 guide the user. The user then applies a burnishing action to the upper surface 50 of the grid transfer sheet opposite the letter 103 which is to be removed using a stylus 125 or appropriate other tool. The low-tack adherence of the selected indicia 103 to its backing sheet 100 allows it to be removed and transferred to the underside of the grid transfer sheet 50. The low-tack adhesive on the underside of the grid transfer sheet is selected to have a greater retention force than that adhering the indicia to sheet 100 so that as the grid transfer sheet is burnished and subsequently separated from the backing sheet, the desired letter 103 will be transferred to the underside of the grid sheet at the precise desired location. The presence of the intersecting grid lines provides the user reference for placement and spacing of the letters. Further, since the grid transfer sheet is transparent, the letters on the backing sheet are visible to the user. The flange 22 provides a surface to permit the user to steady the device on the work surface by application of manual force.

Once the selected letter has been transferred to the underside of the grid transfer sheet, as for example the letter "A" in the word "ART", subsequent indicia or letters can be selected and also transferred to the underside of the grid transfer sheet at the appropriate location and with the appropriate spacing. As each subsequent letter 13 is burnished and transferred to the underside 62 of the grid transfer sheet 50, the grid transfer sheet is incrementively moved leftward as shown in FIGS. 8B and 8C so the newly transferred letter overlies the protector sheet 70 and is beneath the grid sheet. Protector sheet 70 prevents the letter which has been temporarily transferred to the underside of the grid transfer sheet from adhering to the work surface. Since the grid transfer sheet is clear and the protector sheet tinted, the protector sheet is clearly visible through the grid sheet. Once the composition is completed, as for example the word "ART", the letters are then ready to be transferred and permanently applied to a suitable surface or substrate.

Figure 8D:
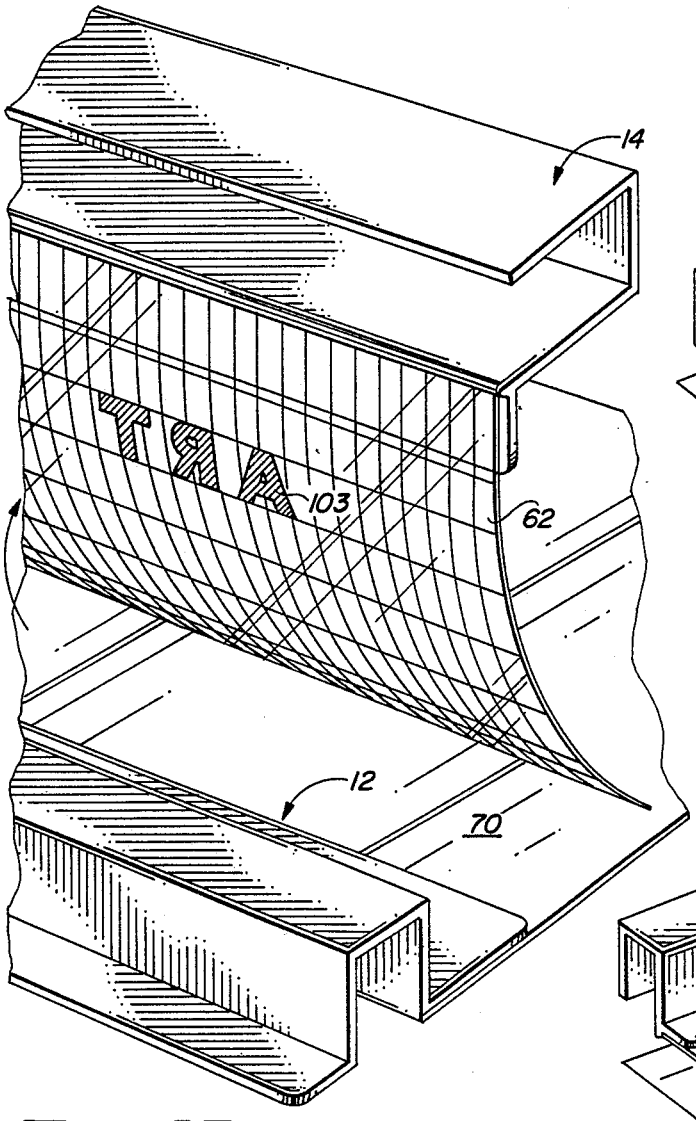
Figure 8E:
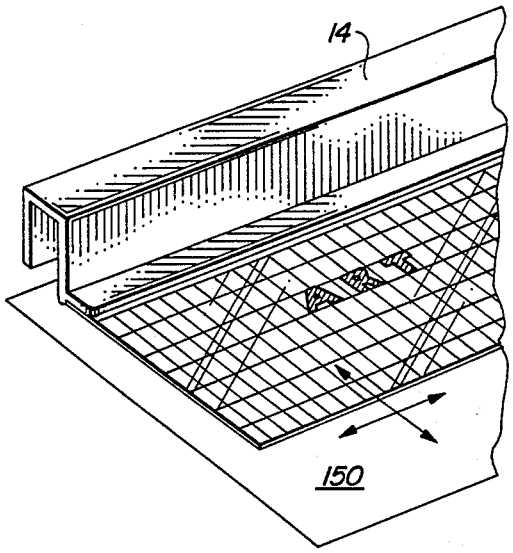
Figure 8F:
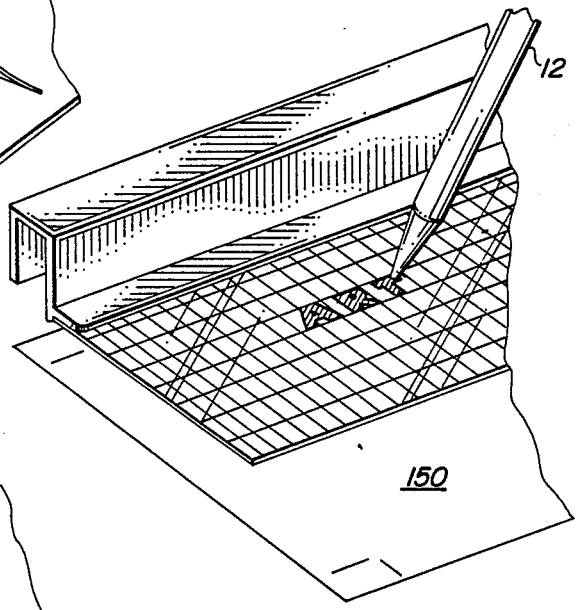
Figure 8G:
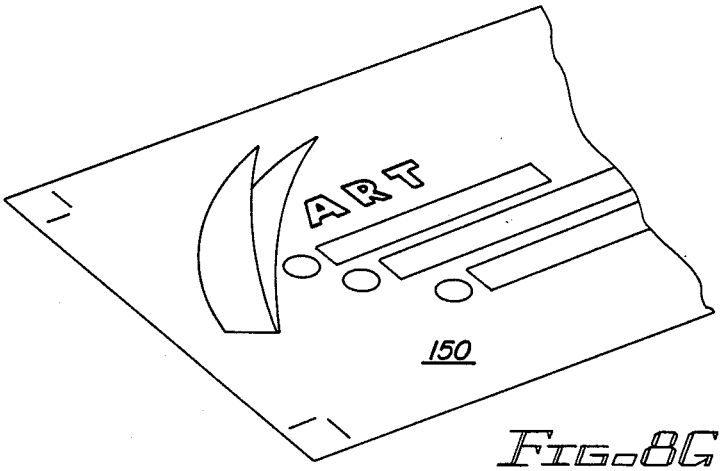

As seen in FIG. 8D, slide member 14 and attached grid transfer sheet with temporarily affixed letters is disengaged from the track member 12 by vertically separating these members. The slide provides a convenient means of manually supporting the grid transfer sheet during the transfer to prevent the sheet from folding or flexing excessively. The attached slide also provides a convenient means of grasping the grid transfer sheet without coming into contact with the adhesive surface 62. The grid transfer sheet is placed over the mounting surface or substrate 150 to which the letters are to be affixed and carefully positioned in the desired location on the surface using the grid lines for reference, as seen in FIG. 8E. The letters are then brought into contact with the surface 150 and the upper surface of the grid transfer sheet burnished with a stylus 25 as shown in FIG. 8F. This burnishing action will permanently transfer the letters to the substrate surface. The grid transfer sheet is then lifted leaving the letters permanently affixed to the completed artwork substrate as illustrated in FIG. 8G.

It will thus be seen that with the device of the invention, indicia may be conveniently and accurately arranged on the underside of the grid transfer sheet with the protector sheet 70 preventing the temporarily transferred indicia from sticking to the work surface. The grid arrangement assists in proper alignment and spacing of the letters and numbers. Once the desired combination of indicia is composed and transferred to the underside of the grid transfer sheet, the grid transfer sheet along with its associated slide can be removed and positioned over the substrate. The slide being attached to the grid sheet provides a convenient means of holding the grid sheet and attached letters during the transfer process. The grid or sheet 50 also provides a convenient reference for the accurate positioning and transfer of the letters to the substrate.

FIGS. 4 and 5 show an alternate construction for the device of the present invention which is generally designated by the numeral 200. In this embodiment, the track 212 is fabricated from an aluminum or plastic extrusion having a planar bottom wall 215, rear wall 216 and forwardly extending flange 217 having a downwardly turned distal end or lip 218. Protector sheet 220 is shown as being rectangular having its upper marginal edge 222 secured to the underside of bottom wall 215. The protector sheet 220 is, as has been described with reference to previous figures, translucent and preferably tinted having an upper surface 225 which is coated with a nonwettable, nonstick coating.

Slide 214 is movable relative to the track and is shown as being extruded from a plastic or hard rubber material. The slide has a planar bottom surface 230 opposite longitudinal side walls 226 and 228 and upwardly inclined upper surface 230. A longitudinally extending generally semicircular projection 235 is provided on the upper surface of the slide at an intermediate location. The projection is adapted to be engaged by the lip 218 of flange 217 to restrict lateral movement of the slide while permitting longitudinal movement and disassembly of the slide from the track. The bottom surface 230 of the slide is secured to grid transfer sheet 240 which is as has been described above provided with a low-tack adhesive coating on its underside. The grid sheet is transparent and provided with intersecting reference grid lines 242 and 244. In operation, the device is used as has been described with reference to FIGS. 8A to 8G. The track can be manually held in position by the user by applying manual pressure to the upper surface of flange 217 which allows the slide 214 to be moved to the desired position to pick up letters for temporary reception on the underside of the grid sheet 240. Thereafter, the slide may be progressively moved leftward as additional letters are temporarily adhered to the grid transfer sheet with the letters placed in registry with the protector sheet to prevent the accidental transfer or damage to the letters. The slide 214 is then moved to an extreme right or left position to disengage it from track 212 and the composed letters placed over the mounting surface. The attached slide and grid transfer sheet facilitate transfer of the composition and positioning and permanent affixation to the permanent mounting surface.

It will be obvious to those skilled in the art to make various change, alterations and modifications to the slidable indicia alignment and transfer device of the present invention. To the extent such changes, alterations and modifications do not depart from the spirit and scope of the appended claims, they are intended to be encompassed herein.

We claim:

1. An alignment and transfer device for applying selected indicia to a substrate to form a composition of indicia, said indicia being releasably attached to a backing with a low-tack adhesive, said device comprising:

(a) a longitudinally extending track adapted to rest on a working surface;

(b) a protector sheet having an upper surface secured to said track at a marginal edge thereof and adapted to be placed on a working surface;

(c) a slide engaging and movable along said track and being disengageable therefrom;

(d) a transparent grid sheet attached to said slide having an upper and lower surface and at least partially overlying said protector sheet when said slide and track are engaged with the lower surface of said grid sheet and the upper surface of said protector sheet being adjacent one another, said lower surface of said grid sheet having a low-tack adhesive thereon, said grid sheet having reference markings thereon, whereby selected indicia may be aligned and transferred to the underside of said grid sheet by application of pressure through said grid sheet and thereafter moved to overlie said protector sheet by manipulation of said slide and upon completion of the composition of indicia said slide and grid sheet are disengageable from said track and protector sheet and are transferable to said substrate to permit said indicia to be permanently applied to said substrate.

2. The device of claim 1 wherein said grid sheet is a flexible polymeric film.

3. The device of claim 1 wherein said protector sheet is a flexible polymeric film.

4. The device of claim 2 wherein said grid sheet is provided with a regular grid system imprinted thereon.

5. The device of claim 3 wherein said protector sheet is tinted.

6. The device of claim 1 wherein the said upper surface of said protector sheet is coated with a release agent.

7. The device of claim 6 wherein said release coating is treated with a roughening material.

8. The device of claim 6 wherein said roughening material comprises silica particles.

9. An alignment and transfer device for applying selected indicia to a substrate to form a composition of indicia, said indicia being releasably provided on a backing sheet with a low-tack adhesive, said device comprising:

(a) a track having a longitudinally extending guide member having spaced-apart legs with a flange projecting from each leg adapted to rest on a work surface;

(b) a protector sheet having an upper surface coated with a release agent, said protector sheet being secured to one of said flanges along a marginal edge thereof;

(c) a slide member having a body slidably engaging said track and being disengageable therefrom;

(d) a transparent grid sheet attached to said slide member having an upper and lower surface and at least partially overlying said protector sheet when said slide and track are engaged, said lower surface having a low-tack adhesive thereon, said grid sheet being provided with reference markings thereon;

(e) whereby selected indicia may be aligned and transferred to the underside of said grid sheet by application of pressure through said grid sheet and thereafter moved to overlie said protector sheet by manipulation of said slide member and upon completion of the composition of indicia said slide member and grid sheet are disengageable from said track and protector sheet and are transferable to said substrate to permit said indicia to be permanently applied to said substrate.

* * * * *